US007168561B2

(12) United States Patent
Dufresne

(10) Patent No.: US 7,168,561 B2
(45) Date of Patent: Jan. 30, 2007

(54) PACKAGED ROLL OF TEXTILE FABRIC AND METHOD OF PACKAGING SAME

(75) Inventor: Elizabeth Dufresne, Harpswell, ME (US)

(73) Assignee: Saint-Gobain Technical Fabrics Canada, Ltd., Northborough, MA (US)

( * ) Notice: Subject to any disclaimer, the term of this patent is extended or adjusted under 35 U.S.C. 154(b) by 131 days.

(21) Appl. No.: 11/010,651

(22) Filed: Dec. 10, 2004

(65) Prior Publication Data

US 2006/0124490 A1 Jun. 15, 2006

(51) Int. Cl.
*B65D 85/66* (2006.01)

(52) U.S. Cl. ..... 206/410; 53/469

(58) Field of Classification Search ..... 206/389, 206/391, 392, 398, 407–411, 812; 383/61.2, 383/63, 123–125; 53/467–469
See application file for complete search history.

(56) References Cited

U.S. PATENT DOCUMENTS

| | | | | | |
|---|---|---|---|---|---|
| 3,842,977 | A * | 10/1974 | Hollander | 206/407 |
| 3,892,310 | A * | 7/1975 | Welin-Berger | 206/812 |
| 4,240,241 | A | 12/1980 | Sanborn, Jr. | |
| 4,274,573 | A * | 6/1981 | Finkelstein | 206/409 |
| 4,535,912 | A * | 8/1985 | Bonk | 206/409 |
| 4,617,683 | A | 10/1986 | Christoff | |
| 5,046,300 | A | 9/1991 | Custer et al. | |
| 5,111,643 | A | 5/1992 | Hobock | |
| 5,988,880 | A * | 11/1999 | Tomic | 383/63 |
| 6,004,032 | A * | 12/1999 | Kapperman et al. | 383/63 |
| 6,712,510 | B2 | 3/2004 | Schneider et al. | |
| 2004/0091432 | A1 * | 5/2004 | Dulin | 424/49 |

OTHER PUBLICATIONS

FreshLock® Zipper, A guide to commonly used Terms, Trade Literature, pp. 1-3, Sep. 9, 2004.
FreshLock® Zipper, FreshLock Zipper for every need, pp. 1-2, Sep. 9, 2004.
FreshLock® Zipper, What's New?, pp. 1-2, Sep. 9, 2004.
FreshLock® Zipper, Breakthroughs in convenience and package performance, pp. 1-3, Sep. 9, 2004.

* cited by examiner

*Primary Examiner*—Luan K. Bui
(74) *Attorney, Agent, or Firm*—Duane Morris LLP

(57) ABSTRACT

Packaging rolls and a method of packaging rolls of textile fabric are provided in which a roll of textile fabric having first and second transverse ends and a longitudinal length is inserted within a polymeric bag disposed over the roll. The polymeric bag includes a reclosable closure strip comprising at least one rib and one groove oppositely disposed on an inner surface of the polymeric bag proximate to the bag opening. The polymeric bag is designed to provide water and abrasion resistance to rolls of textile goods of about 3–16 feet in length and about 6–24 inches in diameter. The bag can also be reused for partially used rolls.

14 Claims, 2 Drawing Sheets

PACKAGED ROLL OF TEXTILE FABRIC AND METHOD OF PACKAGING SAME

FIELDS OF THE INVENTION

This invention relates to the packaging of textile rolls, and especially packaging which is water and dust resistant and easy to open by hand.

BACKGROUND OF THE INVENTION

Textile fabrics, such as those made from nylon, wool, cotton, polyester, rayon and blends used in the garment industry often shipped in large rolls of 3, 4, 8 or 12 foot lengths, and 6–24 inches in diameter, for example. Textile fabrics used as carpet underlayments and as reinforcements in polymer matrix composites, are similarly packaged. Typically, a wound roll is wrapped with plastic in a manual wrapping process. The plastic wrap helps to maintain moisture protection for the fabric during shipment and storage. Moisture protection is important since many glass reinforcement fabrics include sizings or coatings which are susceptible to wet out or blocking. Wet out occurs when the resin in the sizing or coating reacts with water to cause the resin to become soluble or react with the water molecules. In blocking, the resin which wets out acts as an adhesive to join adjacent layers of the fabric in the roll into a solid mass or block. Accordingly, moisture contamination in certain types of coated or sized fabric can lead to expensive damage to textile goods.

Once fabric rolls are wrapped in plastic they are often placed in specially made corrugated boxes for shipment. The cost of both plastic wrapping and corrugated boxes represents a significant portion of the overall cost of a fabric roll. Accordingly, there is a need for a moisture resistant packaging for fabric rolls which is more cost effective than plastic wrap and a corrugated box. In addition, there is a present need to enhance fabric roll packaging so that end users can reuse the packaging for partial rolls.

SUMMARY OF THE INVENTION

The present invention provides a packaged roll of textile fabric comprising a roll of textile fabric having first and second transverse ends and a longitudinal length. The packaged roll further includes a polymeric bag disposed over the roll of textile fabric. The polymeric bag comprising a reclosable closure strip including at least one rib and at least one groove oppositely disposed on an inside surface of the polymeric bag proximate to its opening. The polymeric bag provides a substantially moisture protective layer around the roll of textile fabric.

Accordingly, the packaging of this invention enables fabric rolls with water-sensitive sizing and/or coatings, to be protected from surrounding moisture. The innovative packaging in this invention also maintains moisture protection of the packaged roll against environmental exposure and ambient humidity. This packaging innovation also enables end users to reuse polymeric bags for partial rolls simply by engaging the rib and groove of the closure strip to seal the bag once a partial roll has been inserted. The present invention preferably employs jumbo "Ziploc" style bags to pack rolls of textile fabrics and thus, can replace the current 2-layer system which includes plastic wrap and corrugated boxes. The elimination of packaging layers reduces about 60 pounds of cardboard waste per pallet, or approximately 3.5 wt. %. Lower weight can improve fuel efficiency in shipping such products.

These bags also eliminate at least one repetitive motion task involved in packaging rolls, i.e., hand wrapping rolls with stretch tape and film for moisture protection. This invention also reduces product cost and minimizes the exposure of workers to glass dust in packing areas by reducing the amount of handling needed.

In a further embodiment of this invention, the method of packaging a roll of textile fabric is provided which includes providing a roll of textile fabric having first and second transverse ends and a longitudinal length, followed by providing a polymeric bag having a reclosable closure strip thereon, inserting a roll of said textile fabric into said polymeric bag and closing said reclosable closure strip whereby said textile fabric roll is protected from damaging moisture absorption. The preferred polymeric bag of this invention includes a polyethylene film enclosure with a polyethylene enclosure strip including at least two grooves and two ribs. The preferred bag includes a generally rectangular shape with a fold at the bottom, two parallel seams on each transverse end and a longitudinal closure strip along one side approximately two inches from the edge opposite the fold in the bag. The preferred polyethylene bag can also have a gray, green, orange, blue or brown tint, for example, which may assist in minimizing UV transmission.

DESCRIPTION OF THE DRAWINGS

The accompanying drawings illustrate the preferred embodiment of the invention so far devised for the practical application of the principles thereof, and in which.

DETAILED DESCRIPTION OF INVENTION

Figure 1:
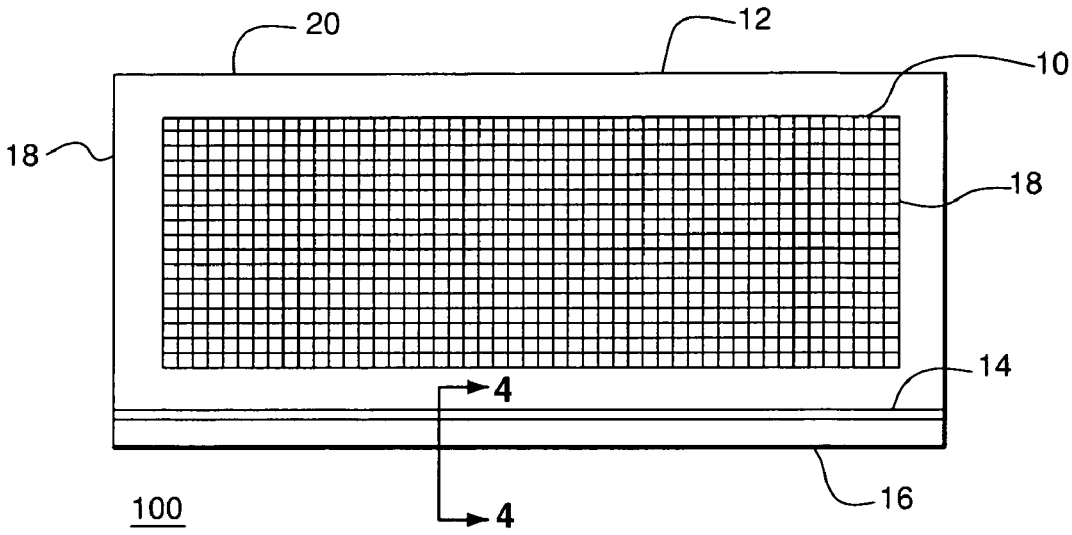
FIG. 1: is a top planar view of a roll of textile fabric sealed within the polymeric bag of this invention.

Referring to FIG. 1–4, this invention provides a roll of textile fabric 10 which includes first and second transverse ends and a longitudinal length. A polymeric bag 12 is disposed over the roll of textile fabric 10 and comprises a reclosable closure strip 14 comprising one or more rib portions 48 and one or more groove portions 50 oppositely disposed on an inside surface of the polymeric bag 12 proximate to its opening 16. The polymeric bag 12 provides a moisture protective layer around the roll of textile fabric 10. Preferably the polymeric bag is rated water resistant, and alternatively, can be tinted, such as with a blue tint, to minimize UV radiation penetration. In the most preferred embodiment, the polymeric bag 12 includes a thermoplastic film for abrasion resistance, which film is folded along a first longitudinal axis to create a fold 20. Each of the transverse ends of the bag 12 are provided with a seam, such as by heating, adhesive or ultrasonic welding.

Figure 4:
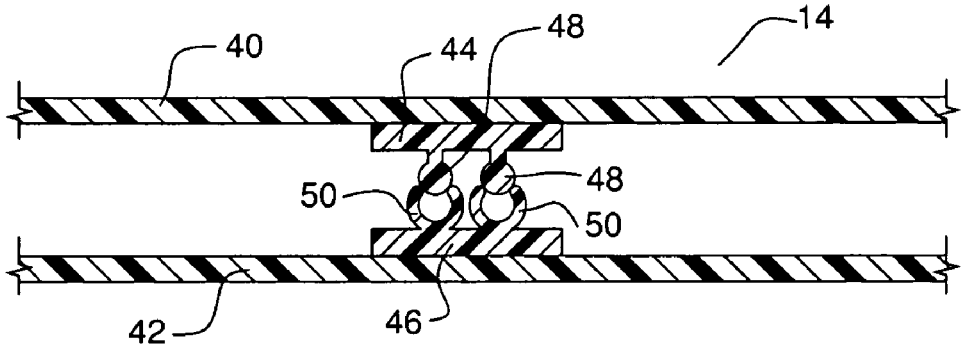
FIG. 4: is a side elevation, cross-sectional view taken through line 4—4 of FIG. 1, illustrating the reclosable closure strip of the polymeric bag.

The opening 16 located along another longitudinal side of the bag 12 is provided with a reclosable closure strip 14. The closure strip 14, shown in FIG. 4, is preferably a double rib and double groove strip. The strip 14 comprises the male or rib portions 48 which interlock into the female or grooved portions 50. As shown, there are two interlocking ribs which extend longitudinally on the rib portion 48 which snap fit into the corresponding longitudinal grooves on the groove portions 50. The present invention is not limited to any particular number of interlocking ribs and grooves as satisfactory closure strips can be made with one rib and one groove or with a plurality of ribs and grooves. The main criteria are that the rib and groove portions of the closure strip be readily separable by the fingers of the consumer who has purchased the package and that they be readily reclosable. Furthermore, there is no necessity for the rib portion to be on the lower closure strip segment or on the upper segment as the closure strip will function properly either way.

Any material which will suit the purpose for which the bag 12 is intended may be employed. Thin sheet-form packaging material such as thermoplastic resinous compositions, which can be gas or water impervious or both, in the form of a single layer or laminated extruded film formed from polyethylene, polypropylene, ethylene vinyl acetate (EVA), low density polyethylene (LDPE), and the like, may be utilized. Alternatively, non-wovens, wovens and coated paper or tissue could be employed. Such material is adapted to be formed into bags on a continuous production line wherein the material is supplied to bag production apparatus which may or may not be combined with bag filling and sealing means. Generally, because extrusion can be carried out at a much greater speed than most bag making and filing apparatus can utilize the material, the sheet of film of whatever character, hereinafter to be generically referred to as web, is rolled into suitable supply rolls since the rolling process can be effected at the same speed as the extrusion and web curing takes place, and then the supply rolls are utilized for supplying bag making web to the bag forming apparatus, which may be combined with means for filling the bags with textile rolls. Alternatively, the bags can be pre-made and provided in rolls, or stacked neatly for use in a packaging operation.

Figure 2:
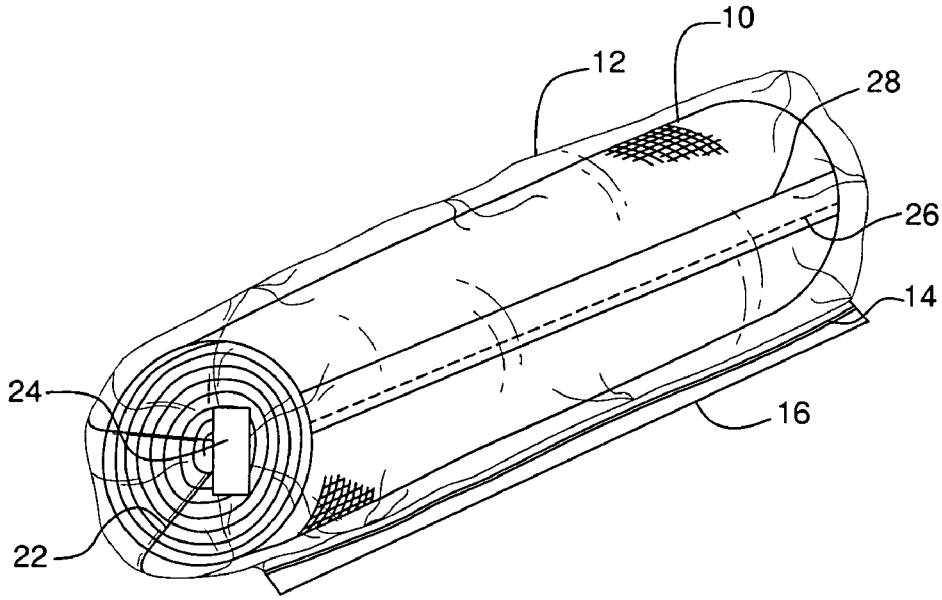
FIG. 2: is a front perspective view of the packaged roll of textile fabric of FIG. 1, showing a taped end.

As shown in FIG. 2, the generally rectangular polymeric bag 12 is somewhat wider than the roll of textile fabric 10, so as to accommodate the diameter of the roll. It is preferred that the cut edge 26 of the fabric roll 10 be secured in some fashion, for example by a strip of tape 28. Once inserted into the opening 16 of the polymeric bag 12, the reclosable closure strip 14 is closed by hand to seal the rib portions 48 into the groove portions 50. This provides a water tight, and preferably airtight, seal. The loose corners 22 of the polymeric bag 12 can also be held down with tape 24 in order to avoid inadvertent tearing or puncture of the bag 12 during transport. The resulting packaged roll 100 reduces product packaging costs, since a cardboard box is not necessary and mechanical wrapping, manually or by automated means, can be eliminated. The moisture protection for the roll 10 is improved since the reclosable closure strip preferably has a water resistant rating.

Figure 3:
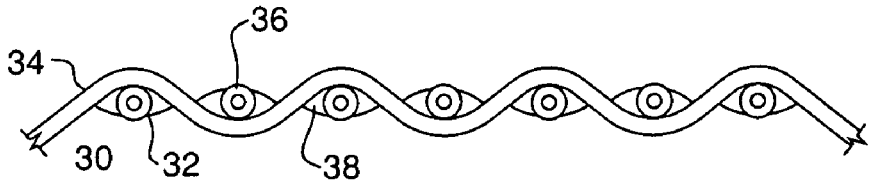
FIG. 3: is a partial side elevation of the roll of textile fabric of FIG. 1, showing a woven construction.

With reference to FIG. 3, a preferred fabric is disclosed for use in the packaged roll 100 of this invention. The textile fabric of this invention can be provided in woven and non-woven forms, including for example, weft yarns 32 and warp yarns 34 in a woven configuration. The filaments 30 of the yarn can be coated or just sized, and the resulting fabric can include an additional coating 38. For the purposes of this invention, the coating 38 can be applied to the yarns before or after sizing, prior to or after weaving, knitting or sewing, for example, to coat the fibers, yarns, and/or overall fabric.

The fabric of this invention can contain fibers and filaments of organic and inorganic materials, such as glass, olefin (such as polyethylene, polystyrene and polypropylene), Kevlar®, graphite, rayon, polyester, carbon, graphite, cotton, wool, ceramic fibers, or combinations thereof, such as glass polyester blends or Twintex® glass-olefin (polypropylene or polyethylene) composite, available from Companie de Saint-Gobain, France. Of these types of fibers and filaments, glass compositions are the most desirable for their fire resistance, low cost and high mechanical strength properties.

Once the continuous fibers have been produced they must be converted into a suitable form for their intended application. The major finished forms are continuous roving, woven roving, fiberglass mat, chopped strand, and yarns for textile applications. Yarns are used in many applications of this invention.

Fiberglass roving is produced by collecting a bundle of strands into a single large strand, which is wound into a stable, cylindrical package. This is called a multi-end roving process. The process begins by placing a number of oven-dried forming packages into a creel. The ends are then gathered together under tension and collected on a precision roving winder that has constant traverse-to-winding ratio, called the waywind.

Rovings are used in many applications of this invention. Woven roving is produced by weaving fiberglass roving into a fabric form. This yields a coarse product. The course surface is ideal for polymer matrix composites, cement board, road patch, soil reinforcement, and adhesive applications, since these materials can bind to the coarse fibers easily. Plain or twill weaves are less rough, thereby being easier to handle without protective gloves, but will absorb matrices and adhesive. They also provide strength in both directions, while a unidirectionally stitched or knitted fabric provides strength primarily in one dimension. Many novel fabrics are currently available, including biaxial, double bias, and triaxial weaves for special applications.

Combinations of mat, scrim, chopped fibers and woven or knit filaments or roving can also be used for the preferred reinforcing thickened fabric constructions. The appropriate weights of fiberglass mat (usually chopped-strand mat) and woven roving filaments or loose chopped fibers are either bound together with a chemical binder or mechanically knit, needled, felted or stitched together.

The yarns of the facing layers of this invention can be made by conventional means. Fine-fiber strands of yarn from the forming operation can be air dried on forming tubes to provide sufficient integrity to undergo a twisting operation. Twist provides additional integrity to yarn before it is subjected to the weaving process, a typical twist consisting of up to one turn per inch. In many instances heavier yarns are needed for the weaving operation. This is normally accomplished by twisting together two or more single strands, followed by a plying operation. Plying essentially involves retwisting the twisted strands in the opposite direction from the original twist. The two types of twist normally used are known as S and Z, which indicate the direction in which the twisting is done. Usually, two or more strands twisted together with an S twist are plied with a Z twist in order to give a balanced yarn. Thus, the yarn properties, such as strength, bundle diameter, and yield, can be manipulated by the twisting and plying operations. Fiberglass yarns are converted to fabric form by conventional weaving operations. Looms of various kinds are used in the industry, but the air jet loom is the most popular.

Zero twist-yarns may also be used. This input can offer the ease of spreading of (twistless) roving with the coverage of fine-filament yarns. The number of filaments per strand used directly affect the porosity and are related to yarn weight as follows: n=(490×Tex)/d2, where "d" is the individual filament diameter expressed in microns. Thus, if the roving with coarse filaments can be replaced with near zero twist yarn with filaments half the diameter, then the number of filaments increases by a factor of 4 at the same strand Tex.

The major characteristics of the woven embodiments of this invention include its style or weave pattern, fabric count, and the construction of warp yarn and fill (weft) yarn. Together, these characteristics determine fabric properties such as drapability. The fabric count identifies the number of warp and fill or weft yarns per inch. Warp yarns run parallel to the machine direction, and weft yarns are perpendicular.

There are basically four weave patterns: plain, basket, twill, and satin. Plain weave is the simplest form, in which one warp yarn interlaces over and under one fill yarn. Basket weave has two or more warp yarns interlacing over and under two or more fill yarns. Twill weave has one or more warp yarns over at least two fill yarns. Satin weave (crowfoot) consists of one warp yarn interfacing over three and under one fill yarn, to give an irregular pattern in the fabric. The eight harness satin weave is a special case, in which one warp yarn interlaces over seven and under one fill yarn to give an irregular pattern. In fabricating a board, the satin weave gives the best conformity to complex contours, such as around corners, followed in descending order by twill, basket, and plain weaves.

Texturizing is a process in which the textile yarn is subjected to an air jet that impinges on its surface to make the yarn "fluffy". The air jet causes the surface filaments to break at random, giving the yarn a bulkier appearance. The extent to which this occurs can be controlled by the velocity of the air jet and the yarn feed rate. An equivalent effect can be produced by electrostatic or mechanical manipulation of the fibers, yarns or roving.

The fabric pattern, often called the construction, is an x, y coordinate system. The y-axis represents warp yarns and is the long axis of the fabric roll (typically 30 to 150 m, or 100 to 500 ft.). The x-axis is the fill direction, that is, the roll width (typically 910 to 3050 mm, or 36 to 120 in.). Basic fabrics are few in number, but combinations of different types and sizes of yarns with different warp/fill counts allow for hundreds of variations.

Basic fabric structures include those made by woven, non-woven and knit processes. In this invention, one preferred design is a knit structure in which both the x axis strands and the y axis strands are held together with a third strand or knitting yarn. This type of knitting is weft-inserted-warp knitting. If an unshifted tricot stitch is used, the x and y axis strands are the least compressed and, therefore, give the best coverage at a given areal weight. This structure's coverage can be further increased, i.e., further reduction in porosity, by using near-zero-twist-yam or roving which, naturally, spreads more than tightly twisted yarn. This design can be further improved by assisting the spreading of filaments by mechanical (needling) means, or by high-speed air dispersion of the filaments before or after fabric formation.

The most common weave construction used for everything from cotton shirts to fiberglass stadium canopies is the plain weave. The essential construction requires only four weaving yarns: two warp and two fill. This basic unit is called the pattern repeat. Plain weave, which is the most highly interlaced, is therefore the tightest of the basic fabric designs and most resistant to in-plane shear movement. Basket weave, a variation of plain weave, has warp and fill yarns that are paired: two up and two down. The satin weave represent a family of constructions with a minimum of interlacing. In these, the weft yarns periodically skip, or float, over several warp yarns. The satin weave repeat is x yarns long and the float length is x−1 yarns; that is, there is only one interlacing point per pattern repeat per yarn. The floating yarns that are not being woven into the fabric create considerable loose-ness or suppleness. The satin weave produces a construction with low resistance to shear distortion and is thus easily molded (draped) over common compound curves. Satin weaves can be produced as standard four-, five-, or eight-harness forms. As the number of harnesses increases, so do the float lengths and the degree of looseness making the fabric more difficult to control during handling operations. Textile fabrics generally exhibit greater tensile strength in plain weaves, but greater tear strength in satin weaves. The higher the yarn interlacing (for a given-size yarn), the fewer the number of yarns that can be woven per unit length. The necessary separation between yarns reduces the number that can be packed together. This is the reason for the higher yarn count (yarns/in.) that is possible in unidirectional material and its better physical properties.

A plain weave having glass weft and warp yarns or roving, in a weave construction is known as locking leno. The gripping action of the intertwining leno yarns anchors or locks the open selvage edges produced on rapier looms. The leno weave helps prevent selvage unraveling during subsequent handling operations. However, it is also valuable where a very open (but stable) weave is desired.

The design of glass fabrics suitable for this invention begins with only a few fabric parameters: type of fiber, type of yarn, weave style, yarn count, and areal weight.

Fiber sizing, binder or finish is also important because it helps lubricate and protect the fiber as it is exposed to the sometimes harsh weaving operation. The quality of the woven fabric is often determined by the type and quality of the fiber finish. The finish of choice, however, is usually dictated by end-use and resin chemistry, and can consist of resinous materials, such as epoxy.

The following fabric styles and categories are useful in the practice of this invention:

| Fabric | Areal wt. grams/m$^2$ | oz/yd$^2$ |
|---|---|---|
| Light weight | 102–340 | 3–10 |
| Intermediate weight | 340–678 | 10–20 |
| Heavy weight | 508–3052 | 15–90 |

| | Thickness | |
|---|---|---|
| Fabric | μm | mil |
| Light weight | 25–125 | 1–5 |
| Intermediate weight | 125–250 | 5–10 |
| Heavy weight | 250–500 | 10–20 |

The warp yarn 3A and weft yarn 32 of the fabric 10 shown in FIG. 3, preferably have a binder or sizing 36, used to join the filaments 30 to one another and alternatively, or additionally, to other yarns, such as in cross-over points between the warp yarn 34 and weft yarn 32. A typical binder/glass fiber loading is about 3–30 wt %. Such binders may or may not be a barrier coating. These binders also may or may not completely coat the exterior facing fibers. Various binders are appropriate for this purpose, such as, for example, phenolic binders, ureaformaldehyde resin, or ureaformaldehyde resin modified with acrylic, styrene acrylic, with or without carboxylated polymers as part of the molecule, or as a separate additive. Additionally, these binders can be provided with additives, such as UV and mold inhibitors, fire retardants, etc. Carboxylated polymer additions to the binder resin can promote greater affinity to set gypsum, or to Portland cement-, for example, but are less subjected to blocking than resins without such additions. One particularly desirable binder resin composition is a 70 wt % ureaformaldehyde resin-30 wt % styrene acrylic latex or an acrylic latex mixture, with a carboxylated polymer addition.

The roll of fabric 10 of this invention can be further treated or coated with a resinous coating 38 prior to use, to help fix the weft yarn 32 and warp yarn 34 in a preferred sinusoidal pattern, as shown in FIG. 3. Resinous coatings 38 are distinguished from the sizing or binder 36 used to bond the fibers together to form the individual filaments, as described above. Coatings 38 can include those described in U.S. Pat. No. 4,640,864, which is hereby incorporated herein by reference, and are preferably alkali-resistant, water-resistant and/or fire-retardant in nature, or include additives for promoting said properties. They are preferably applied during the manufacture of the roll of fabric 10.

The coating 38 applied to the roll of fabric 10, as shown in FIG. 3, of this invention preferably coats a portion of the fibers and binds the yarns 32 and 34 together. Alternatively, the coating 38 can increase or decrease the wetting angle of the matrix to reduce penetration into the yarns or increase adhesion. The coating 38 can further contain a UV stabilizer, mold retardant, water repellant, a flame retardant and/or other optional ingredients, such as dispersants, catalysts, fillers and the like. Preferably, the coating 38 is in liquid form and the roll of fabric 10 is led through the liquid under tension, such as by a tenter frame 105, or the liquid is sprayed (with or without a water spray precursor) on one or both sides of the fabric 10. Thereafter, the fabric 10 may be squeezed and dried.

Various methods of applying the liquid may be used, including dip-coaters, doctor blade devices, roll coaters and the like. One preferred method of treating the fabric 10 with the resinous coatings 38 of this invention is to have a lower portion of one roll partially submerged in a trough of the liquid resinous composition and the fabric 10 pressed against the upper portion of the same roller so that an amount of the resinous composition is transferred to the fabric 10. The second roller above the first roller controls the movement of the fabric 10 and the uniformity of the amount of resinous coating 38 disposed thereon. Thereafter, the coated fabric 10 is led in a preferred method to steam cans to expedite drying. It is preferred to pass the coated fabric over steam cans at about 250–450° F. (100–200° C.) which drives the water off, if a latex is used, and additionally may cause some flow of the liquid resinous material to further fill intersticies between fibers, as well as coat further and more uniformly fibers within the fabric 10. The coating preferably covers about 50–80% of the surface area targeted, more preferably about 80–99% of said area.

The preferred resinous coatings 38 of this invention can contain a resinous mixture containing one or more resins. The resin can contain solid particles or fibers which coalesce or melt to form a continuous or semi-continuous coating which substantially prevents the penetration of liquid moisture, which can be alkaline. The coating can be applied in various thicknesses, such as for example, to sufficiently cover the fibrous constituents of the fabric 10 so that no fibers protrude from the coating 38, or to such a degree that some of the fibers protrude from the coating 38.

The coating 38 of this invention can be formed substantially by the water-resistant resin, but good results can also be achieved by forming the coating or saturant from a mixture of resin and fillers, such as silicates, silica, gypsum, titanium dioxide and calcium carbonate. The coating 38 can be applied in thermoplastic, latex or curable thermosetting form. Acceptable resins include pvc plastisol, styrene/butadiene (such as BASF ND 5600) and styrene/acrylic copolymer, acrylics (such as Paranol SA200 or Rohm & Haas GL 618), flame retardant acrylics or brominated monomer additions to acrylic, such as Pyropoly AC2001, poly(vinyl acetates), poly(vinyl alcohols), vinylidene chloride, siloxane, and polyvinylchloride such as Vycar® 578. Thermosetting resins, such as vinyl esters, epoxy or polyester, could also be used for higher strength and rigidity. In addition, fire retardants, such as bromated phosphorous complex, halogenated paraffin, colloidal antimony pentoxide, borax, unexpanded vermiculite, clay, colloidal silica and colloidal aluminum can be added to the resinous coating or saturant. Furthermore, water resistant additives can be added, such as paraffin, and combinations of paraffin and ammonium salt, fluorochemicals designed to impart alcohol and water repellency, such as FC-824 from 3M Co., organohydrogenpolysiloxanes, silicone oil, wax-asphalt emulsions and poly (vinyl alcohol) with or without a minor amount a minor amount of poly(vinyl acetate). Finally, the coatings 38 can include pigment, such as kaolin clay, or lamp black thickeners.

Figure 5:
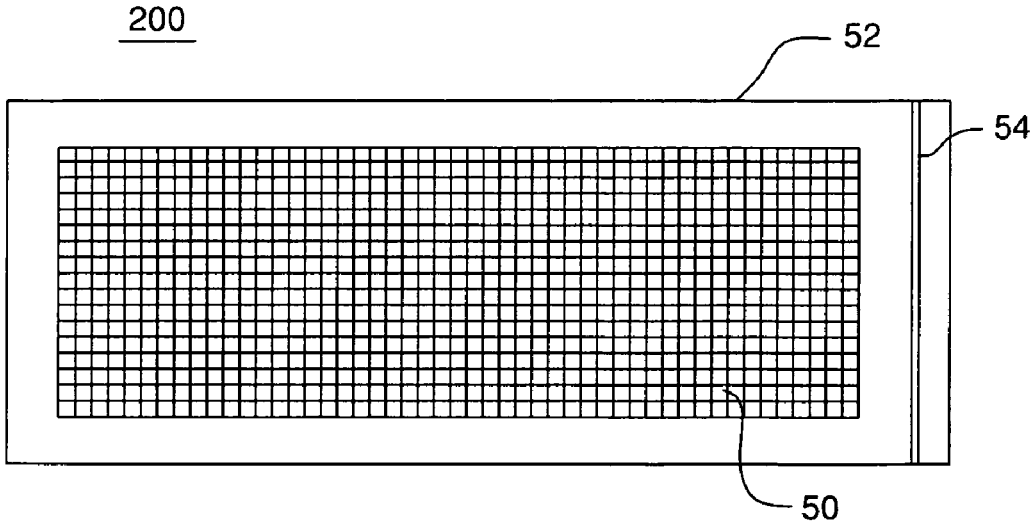
FIG. 5: is a top planar view of an alternative packaged textile fabric roll.

The reclosable closure strip 14 will now be discussed in more detail. In the preferred embodiment of the reclosable closure strip 14, a top polymeric film 40 and bottom polymeric film 42 representing portions of the polymeric bag 12 are provided. The reclosable closure strip 14 comprises a rib portion 48 and a groove portion 50 oppositely disposed on an inside surface of the polymeric bag 12, proximate to the bag's opening 16. In the preferred embodiment, the rib portion 48 includes a pair of ribs, and the groove portion 50 includes a pair of grooves. The grooves are disposed on a groove base 46 which is affixed to bottom film 42, such as by a heat seal or adhesive. The pair of ribs are generally attached to a rib base 44 or flange, which is similarly attached to the top film 40. As such, the preferred reclosable strip 14 is a multi-track closure strip which includes a mechanical interlock which is designed with at least two sets of connectors, with a preferred minimum of two male and two female sections. Alternatively, as shown in FIG. 5, a transverse closure strip 54 can be provided which runs in the transverse direction on the polymeric bag 50 of alternative packaged roll 200. In this embodiment, the transverse reclosable closure strip 54 permits the roll of textile fabric 50 to be disposed end first into the polymeric bag 52.

From the foregoing, it can be realized that this invention provides improved packaged textile rolls and methods of packaging a roll of textile fabric in which product costs are reduced due to the elimination of corrugated cardboard. While it is envisioned that cardboard boxes may still be used and still provide improved crush resistance while maintaining the reusability and water resistance of the polymeric bag, the polymeric bags of this invention can be made thick enough to resist most transport conditions. The present packaging methods eliminate current roll wrapping processes which are labor intensive and costly. The roll goods can be reintroduced into the packaging of this invention even after partial use, so as to maintain moisture protection throughout the life of the roll. Although various embodiments have been illustrated, this is for the purpose of describing, and not limiting the invention. Various modifications, which will become apparent to one skilled in the art, are within the scope of this invention described in the attached claims.

We claim:

1. A packaged roll of textile fabric comprising:

(a) a roll of textile fabric having first and second transverse ends and a longitudinal length; and (b) a polymeric bag disposed over said roll of textile fabric, said polymeric bag comprising a reclosable closure strip comprising at least one rib and at least one groove oppositely disposed on an inside surface of said polymeric bag proximate to its opening; said polymeric bag providing a substantially moisture protective layer around said roll of textile fabric, wherein said polymeric bag is generally rectangular in shape, and at least a pair of corners of said generally rectangular bag are folded over and taped.

2. The package roll of claim 1 wherein said reclosable closure strip is oriented in parallel with, or orthogonally to said longitudinal length of said roll of textile fabrics.

3. The package roll of claim 1 wherein said roll of textile fabric comprises a cut edge which is removably fastened to another portion of said roll.

4. The package roll of claim 1 wherein said polymeric bag comprises polyethylene.

5. The package roll of claim 4 wherein said redo sable closure strip comprises polyethylene.

6. The package roll of claim 1 wherein said polymeric bag is water resistant rated after said reclosable closure strip is closed.

7. The package roll of claim 6 wherein said textile fabric comprises a woven or nonwoven glass fabric comprising a polymeric sizing.

8. The package roll of claim 7 wherein said polymeric bag substantially prevents wet out of said sizing due to moisture.

9. A method of packaging a roll of textile fabric, comprising:

(a) providing a roll of textile fabric having first and second transverse ends and a longitudinal length;

(b) providing a polymeric bag having a reclosable closure strip thereon;

(c) inserting said roll of textile fabric into said polymeric bag; and (d) closing said reclosable closure strip, whereby said textile fabric roll is protected from damaging moisture absorption, wherein said bag is generally rectangular, and at least a pair of corners of said generally rectangular bag are taped.

10. The method of packaging of claim 9 wherein said roll of textile fabric contains a cut edge which is fastened to another portion of said roll prior to said insertion step (c).

11. The method of packaging of claim 10 wherein said cut edge is fastened to another portion of said roll by tape.

12. The method of packaging of claim 9 wherein said insertion step (c) inserts said roll of textile fabric into said polymeric bag in a direction which is either parallel with or orthogonal to the direction of operation of said reclosable closure strip.

13. The method of packaging of claim 9 wherein said polymeric bag provides water resistance to said textile fabric.

14. The method of packaging of claim 9 wherein said providing a polymeric bag step (b) comprises providing a plurality of polymeric bags provided in roll form.

* * * * *